US008015637B2

(12) United States Patent
Papen et al.

(10) Patent No.: US 8,015,637 B2
(45) Date of Patent: Sep. 13, 2011

(54) PATCHWORK BABY BLANKET

(76) Inventors: Virginia P. Papen, Lewisville, TX (US); Terrence J. Papen, Lewisville, TX (US)

( * ) Notice: Subject to any disclaimer, the term of this patent is extended or adjusted under 35 U.S.C. 154(b) by 0 days.

(21) Appl. No.: 12/662,314

(22) Filed: Apr. 9, 2010

(65) Prior Publication Data

US 2010/0263122 A1 Oct. 21, 2010

Related U.S. Application Data

(60) Provisional application No. 61/202,896, filed on Apr. 17, 2009.

(51) Int. Cl.
*A47G 9/02* (2006.01)
*A47G 9/04* (2006.01)

(52) U.S. Cl. ..... 5/502; 5/482

(58) Field of Classification Search ..... 5/502, 500, 5/482, 420, 417, 723
See application file for complete search history.

(56) References Cited

U.S. PATENT DOCUMENTS

| | | | | | |
|---|---|---|---|---|---|
| 2,061,510 | A * | 11/1936 | Drumpelmann | 446/115 |
| 2,548,547 | A * | 4/1951 | Melrose | 5/723 |
| 4,242,767 | A * | 1/1981 | McMullen et al. | 446/121 |
| 4,631,765 | A | 12/1986 | Casey | |
| 4,878,258 | A * | 11/1989 | Casey | 5/420 |
| 5,133,096 | A * | 7/1992 | Neumann | 5/702 |
| 5,199,121 | A * | 4/1993 | Payne | 5/502 |
| 5,212,842 | A | 5/1993 | Glydon | |
| 5,321,862 | A * | 6/1994 | Campbell | 5/482 |
| 5,330,806 | A | 7/1994 | Bythewood et al. | |
| 6,463,605 | B2 * | 10/2002 | Swagger, Jr. | 5/420 |
| 2010/0263122 | A1 * | 10/2010 | Papen et al. | 5/502 |

* cited by examiner

*Primary Examiner* — Robert G Santos
(74) *Attorney, Agent, or Firm* — Richard C. Litman

(57) ABSTRACT

The patchwork baby blanket is especially adapted for use by infants and toddlers. The blanket incorporates patches or sections that are detachably connected to create the blanket. The sections are fabricated from soft, pliable, washable material. The sections are decorated with colors and designs that are pleasing to infants and toddlers. Fasteners are provided around the perimeter of each section so that the sections can be easily interlocked.

6 Claims, 3 Drawing Sheets

PATCHWORK BABY BLANKET

CROSS-REFERENCE TO RELATED APPLICATION

This application claims the benefit of U.S. Provisional Patent Application Ser. No. 61/202,896, filed Apr. 17, 2009.

BACKGROUND OF THE INVENTION

1. Field of the Invention

The present invention generally relates to infant care accessories, and particularly to a patchwork baby blanket constructed of modules or sections that are detachably connected.

2. Description of the Related Art

Outside of the warmth of a parent's gentle touch, the soft soothing feel of a favored blanket often provides the aura of calming security that an infant seeks. Unfortunately the blanket is subject to soiling and often such soiling is confined to a relatively small area of the blanket. Heretofore the entire blanket had to be cleaned (wash and dried) to remove the soil from the small effected area. In many instances separation from this favored blanket is followed by howls of protest and periods of angst that are unabated until the blanket is returned. It would certainly be a boon if the areas of the blanket that needed cleaning could be detached and replaced with similar sections, thereby negating the need for cleaning the entire blanket. This scenario would insure that the blanket is available at all times and in addition lessen the laundry load. Thus, a patchwork baby blanket solving the aforementioned problems is desired.

SUMMARY OF THE INVENTION

The patchwork baby blanket is especially adapted for use by infants and toddlers. The blanket incorporates patches or sections that are detachably connected to create the blanket. The sections are fabricated from soft, pliable, washable material. The sections are decorated with colors and designs that are pleasing to infants and toddlers. The designs may include, but are not limited to, animals, cartoon characters, geometric shapes, letters, numbers, etc. Fasteners (snap fasteners are preferred) are provided around the perimeter of each section so that the sections can be easily interlocked. As presently contemplated, nine 12"×12" sections will be utilized to create a standard size baby blanket. It should be recognized however, that sections of other dimensions could be utilized if desired. Although snap fasteners are preferred, as indicated above, it should also be recognized that other conventional fasteners might be utilized if found suitable.

Accordingly, the invention presents a blanket that is constructed with replaceable sections, which sections are washable and identical or similar in texture. Alternatively, sections of different textures may be utilized if desired. Each section is provided with a colorful design thereon. Fasteners are spaced around the perimeter of each section in identical patterns so that the sections can quickly and easily be attached or detached. The invention provides for improved elements thereof in an arrangement for the purposes described that are inexpensive, dependable and fully effective in accomplishing their intended purposes.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
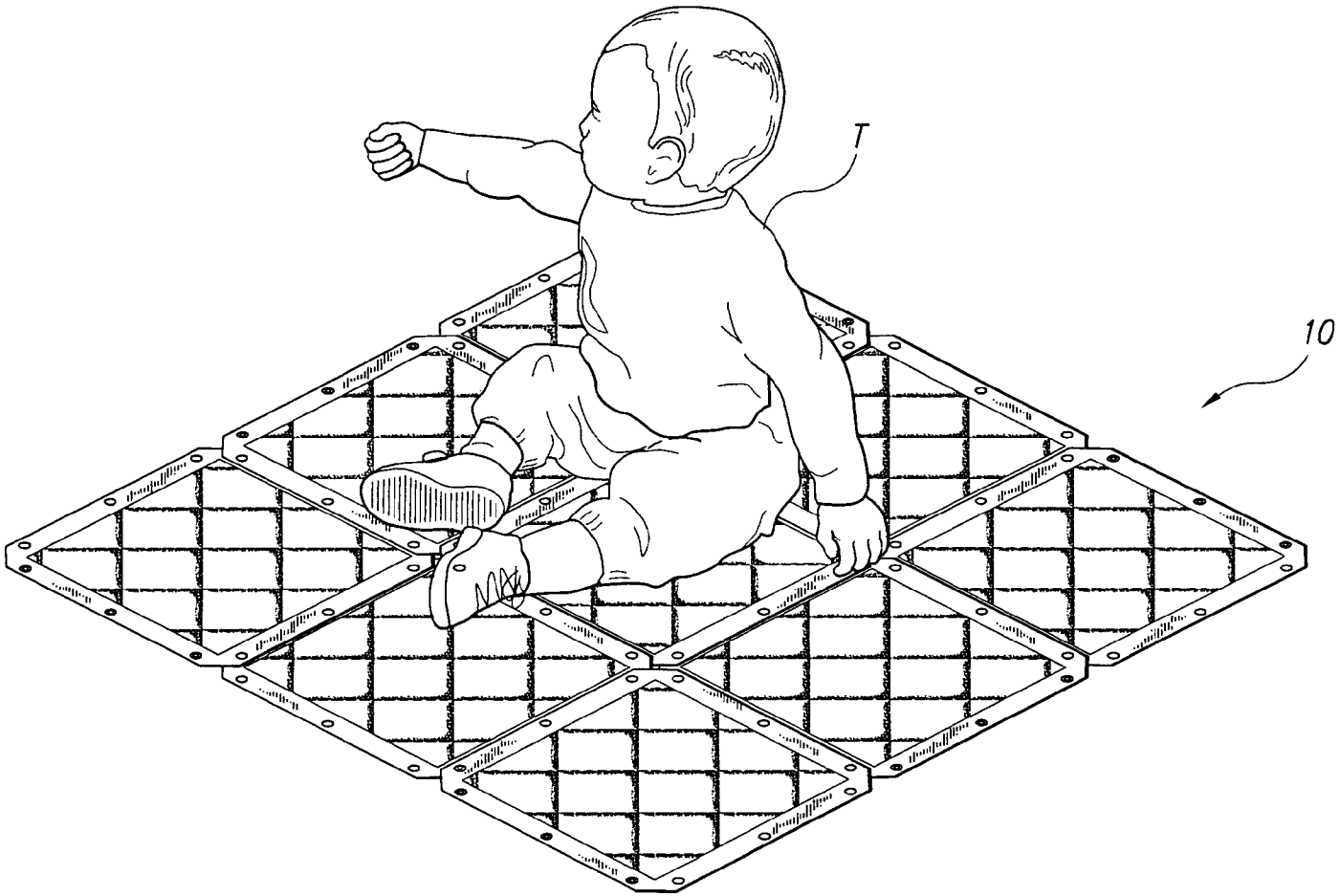
FIG. 1 is an environmental, perspective view of a patchwork baby blanket according to the present invention.
Figure 2:
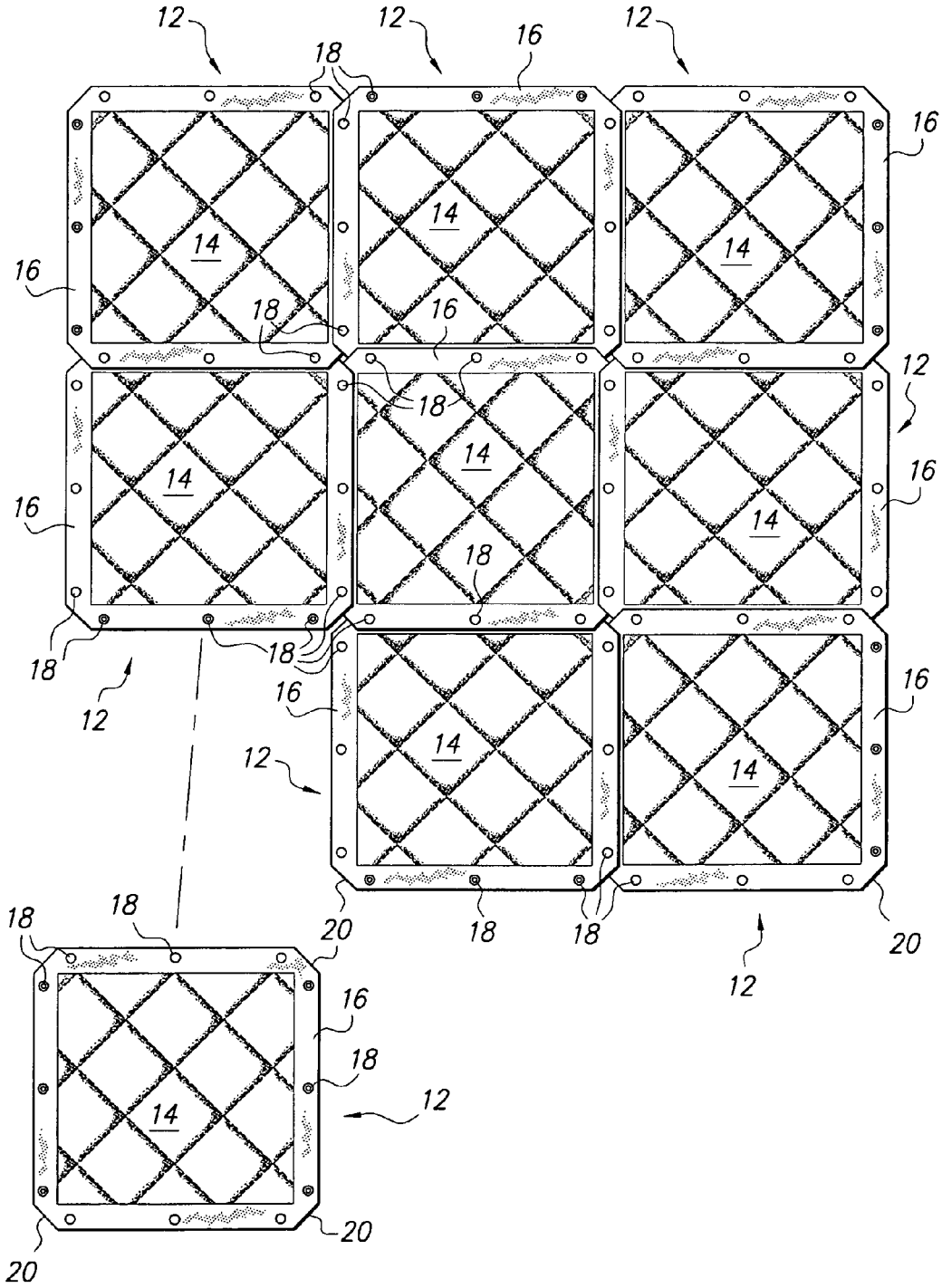
FIG. 2 is an exploded, front view of a patchwork baby blanket according to the present invention.
Figure 3:
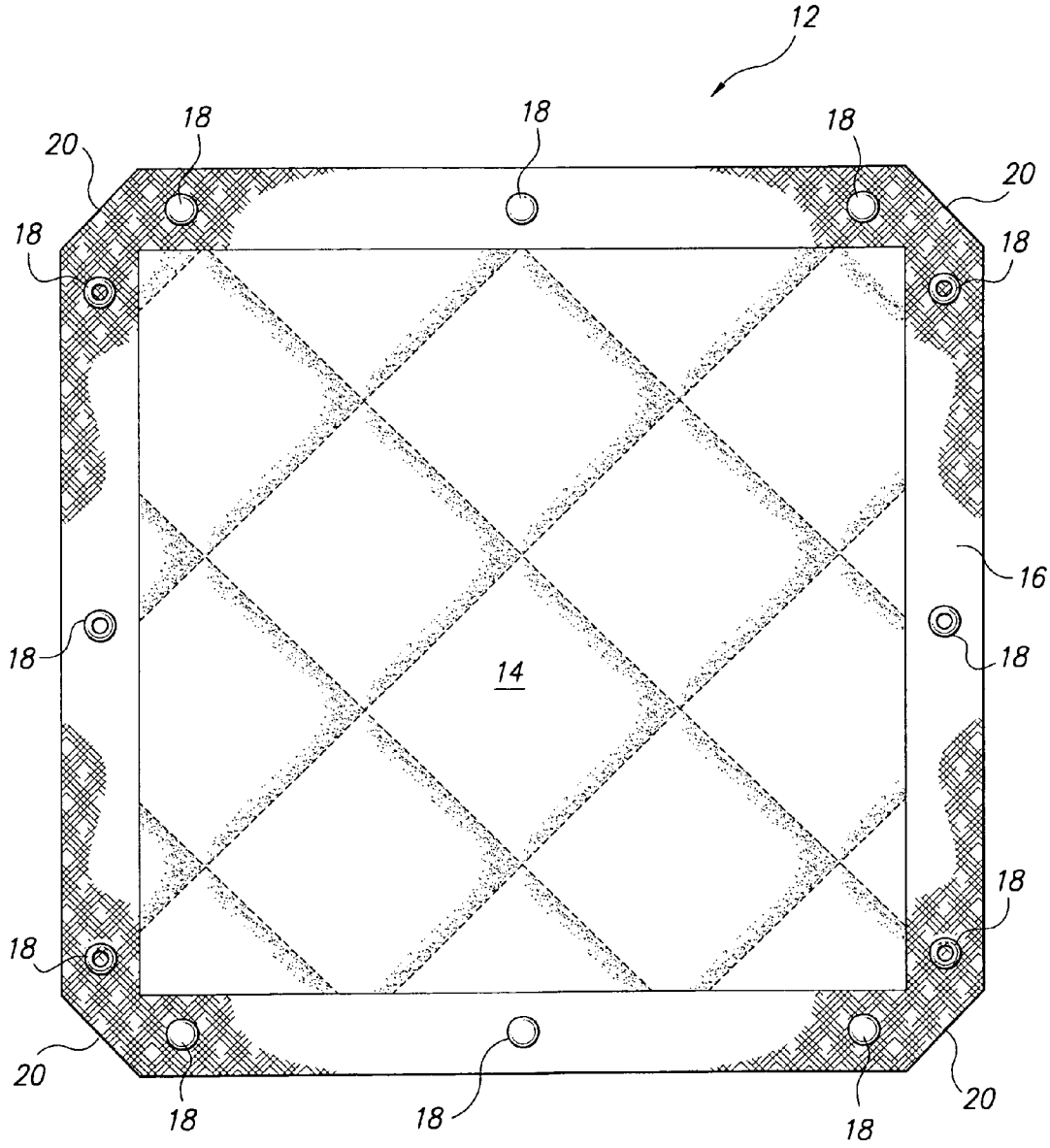
FIG. 3 is a front view of a removable section of a patchwork baby blanket according to the present invention.

Referring to FIGS. 1-3, wherein the patchwork baby blanket is generally indicated at 10 and is utilized to seat a baby or toddler T thereon. As indicated above, blanket 10 is constructed of a plurality of sections 12. Each section 12 is identically constructed and comprises a central area 14 fabricated from soft pliable quilting material. A quilt binding material 16 defines the perimeter of each section. Plastic snaps (for comfort and safety) 18 are spaced around the perimeter in identical patterns so that the sections can be easily fastened together. Each corner 20 of each section is truncated to facilitate manipulation when the section is being attached or detached. Each section can be colored and incorporate a design thereon as indicated above.

It is to be understood that the present invention is not limited to the embodiment described above, but encompasses any and all embodiments within the scope of the following claims.

We claim:

1. A patchwork baby blanket, comprising:

a plurality of identically configured blanket sections, each of the sections having four corners, wherein each of said four corners is truncated at a miter-type angle thereby permitting each section to neatly abut the adjacent sections so as to provide a substantially smooth, flush intersection, each of the sections including:

a central portion having a perimeter, the central portion being fabricated from a soft, pliable quilting material;

a quilt binding attached to the central portion, the binding defining the perimeter of the central portion; and a plurality of fasteners positioned in the quilt binding and spaced around the perimeter.

2. The patchwork baby blanket according to claim 1, wherein said fasteners are spaced in a predetermined pattern around said perimeter.

3. The patchwork baby blanket according to claim 1, wherein each section measures 12"×12".

4. The patchwork baby blanket according to claim 1, wherein said plurality of blanket sections consists of nine identically configured sections.

5. The patchwork baby blanket according to claim 1, wherein said fasteners are snap fasteners and fabricated from plastic.

6. The patchwork baby blanket according to claim 1, wherein said central portion is substantially imperforate.

* * * * *